US006662388B2

(12) United States Patent
Friel et al.

(10) Patent No.: US 6,662,388 B2
(45) Date of Patent: Dec. 16, 2003

(54) PATIENT ADJUSTMENT DEVICE

(76) Inventors: Evelyn M. Friel, 831 E. Second St., Boston, MA (US) 02127; John D. Friel, 7 Winter St., Medford, MA (US) 02155

( * ) Notice: Subject to any disclaimer, the term of this patent is extended or adjusted under 35 U.S.C. 154(b) by 30 days.

(21) Appl. No.: 10/024,457

(22) Filed: Dec. 18, 2001

(65) Prior Publication Data

US 2003/0110560 A1 Jun. 19, 2003

(51) Int. Cl.[7] ..... A61G 7/10
(52) U.S. Cl. ..... 5/86.1; 5/81.1 R; 5/81.1 HS
(58) Field of Search ..... 5/86.1, 81.1 R, 5/81.1 HS, 83.1, 85.1, 87.1, 88.1, 89.1

(56) References Cited

U.S. PATENT DOCUMENTS

| | | | | | |
|---|---|---|---|---|---|
| 2,665,432 | A | * | 1/1954 | Butler | 5/88.1 |
| 2,827,642 | A | * | 3/1958 | Huff | 5/88.1 |
| 4,117,561 | A | | 10/1978 | Zamotin | 5/83 |
| 4,328,951 | A | | 5/1982 | Laupper | 254/89 |
| 4,796,861 | A | | 1/1989 | Petty | 254/8 B |
| 5,090,072 | A | | 2/1992 | Gray | 5/81.1 |
| 5,210,887 | A | * | 5/1993 | Kershaw | 5/86.1 |
| 5,280,657 | A | * | 1/1994 | Stagg | 5/81.1 R |
| 5,560,054 | A | * | 10/1996 | Simon | 5/86.1 |
| 5,608,929 | A | * | 3/1997 | Crane | 5/81.1 R |
| 5,651,149 | A | * | 7/1997 | Garman | 5/81.1 R |
| 5,682,630 | A | * | 11/1997 | Simon | 5/87.1 |
| 5,697,109 | A | * | 12/1997 | Hodgetts | 5/81.1 HS |
| 5,737,781 | A | * | 4/1998 | Votel | 5/81.1 HS |
| 5,819,339 | A | * | 10/1998 | Hodgetts | 5/88.1 |
| 5,890,238 | A | * | 4/1999 | Votel | 5/81.1 HS |
| 5,901,388 | A | * | 5/1999 | Cowan | 5/81.1 HS |
| 5,996,144 | A | * | 12/1999 | Hodgetts | 5/81.1 R |
| 6,282,734 | B1 | * | 9/2001 | Holberg | 5/81.1 HS |
| 6,289,533 | B1 | * | 9/2001 | Hodgetts | 5/81.1 R |
| 6,341,393 | B1 | * | 1/2002 | Votel | 5/81.1 HS |
| 6,378,148 | B1 | * | 4/2002 | Votel | 5/81.1 HS |
| 6,496,991 | B1 | * | 12/2002 | Votel | 5/81.1 HS |
| 6,507,963 | B2 | * | 1/2003 | Hodgetts | 5/81.1 R |
| 6,591,435 | B1 | * | 7/2003 | Hodgetts | 5/88.1 |
| 2001/0044957 | A1 | * | 11/2001 | Hodgetts | 5/81.1 |
| 2003/0110559 | A1 | * | 6/2003 | Weigand | 5/81.1 R |
| 2003/0110560 | A1 | * | 6/2003 | Friel et al. | 5/86.1 |

* cited by examiner

*Primary Examiner*—Robert G. Santos
(74) *Attorney, Agent, or Firm*—Davis & Bujold, PLLC

(57) ABSTRACT

A patient lifting device designed to impart a vertical and corresponding horizontal force component upon a load, namely an ill or incapacitated person in a bed. This vertical and horizontal force results in an incapacitated bed ridden patient being physically adjusted substantially horizontally in a hospital bed, for instance being pulled towards the top of the bed after having migrated towards the bottom of the bed as is quite common. The device utilizes a lifting assembly, a base supporting said lifting assembly, a vertically adjustable shaft, a horizontal load bearing boom-like member for attaching said horizontal load bearing member and a generally flat flexible sheet upon which the patient is supported.

14 Claims, 3 Drawing Sheets

PATIENT ADJUSTMENT DEVICE

FIELD OF THE INVENTION

The present invention relates to an adjustment and lifting device. More specifically the present invention pertains to an apparatus for adjusting the position of a bedridden patient namely a supine, incapacitated or obese patient in a bed. The device is for simultaneous lifting and pulling a bed-ridden patient incapable of self adjustment to a position nearer to the head of the bed, utilizing a minimum of caregiver(s), and minimizing the chance of injury to the care giver(s) engaged in the movement of the patient, i.e. nurses or other hospital or homecare staff.

BACKGROUND OF THE INVENTION

Patient lift devices are known in the art. Most patient lifting devices facilitate the movement of a patient to and from one location to another, such as from the bed in which they are confined to a wheelchair, or to another bed. These devices are normally large and cumbersome to move and operate. These devices usually require a number of people to operate, assemble, and move in preparation for transporting a patient. None of the devices noted in the prior art are designed for, or are efficiently capable of adjusting a patients position on a hospital bed.

Despite our present high tech, highly automated world, the task of adjusting a patient who has slipped down toward the foot of a hospital bed, to a more advantageous, safe and comfortable position in that bed is still done by hand. Generally, the patient is lifted by two or more attendants, working in unison, by grasping the patient under the arms or under the back and physically pulling the patient back towards the head of the bed. Another method includes placing a sheet under the patient by rolling the patient to alternating sides. The sheet is then grasped by two or more attendants and dragged towards the head of the bed, thus the patient laying on top of the sheet is moved back up towards the head of the bed to a more customary and comfortable position.

This procedure can present certain complications when the patient is incapacitated or obese. Back injuries to hospital staff are a significant problem and a common occurrence when attempting to adjust such a patient by hand. Additionally, there is notable risk posed to the patient who may have a weakened or fragile condition due to injury, prolonged illness and confinement to the bed.

The present device is designed to alleviate the problem of work related injuries to care givers caused by having to adjust such a patient manually. The simple design of this patient lifting device overcomes the known disadvantages and offers a convenient and safe method for moving the patient horizontally in a bed. This device is operable by a single attendant and is easy to position and adjust. Also, this design provides a safe, comfortable pulling action that minimizes both discomfort to a patient and the risk of injury to patient and attendant.

SUMMARY OF THE INVENTION

It is an object of the present invention to provide a new and improved patient lifting and moving device for adjusting the position of a patient towards one end of a bed or another.

It is another object of this invention to provide a compact, sturdy and mobile patient lifting device which can be moved from bed to bed or room to room independent of a single patient or bed in order to facilitate the improved arrangement of a number of patients.

It is yet a further object of the invention to provide a safe, convenient and easy to operate patient lifting device operable by a single attendant or care giver.

A still further object of the present invention is to produce an easy to manufacture and relatively economical apparatus for assisting patient care givers in overly strenuous and potentially harmful physical exertions when attempting to reposition patients.

This invention relates to a device that can be generally described as a patient arrangement or positioning device. It consists primarily of a lifting device designed to impart a vertical and corresponding horizontal force component upon a load. This vertical and horizontal force results in an incapacitated bed ridden patient being physically adjusted substantially horizontally in a hospital bed, for instance being pulled towards the top of the bed after having migrated towards the bottom of the bed as is quite common. The device comprises a lifting assembly, a base supporting said lifting assembly, a vertically adjustable shaft, a horizontal load bearing boom-like member, a means for attaching said horizontal load bearing member and a generally flat flexible sheet. The design of the present invention is simple, compact and easily operable by one attendant thus eliminating the need for multiple attendants and reducing the chance of injury to patient and attendant.

DETAILED DESCRIPTION OF THE PREFERRED EMBODIMENTS

Figure 1:
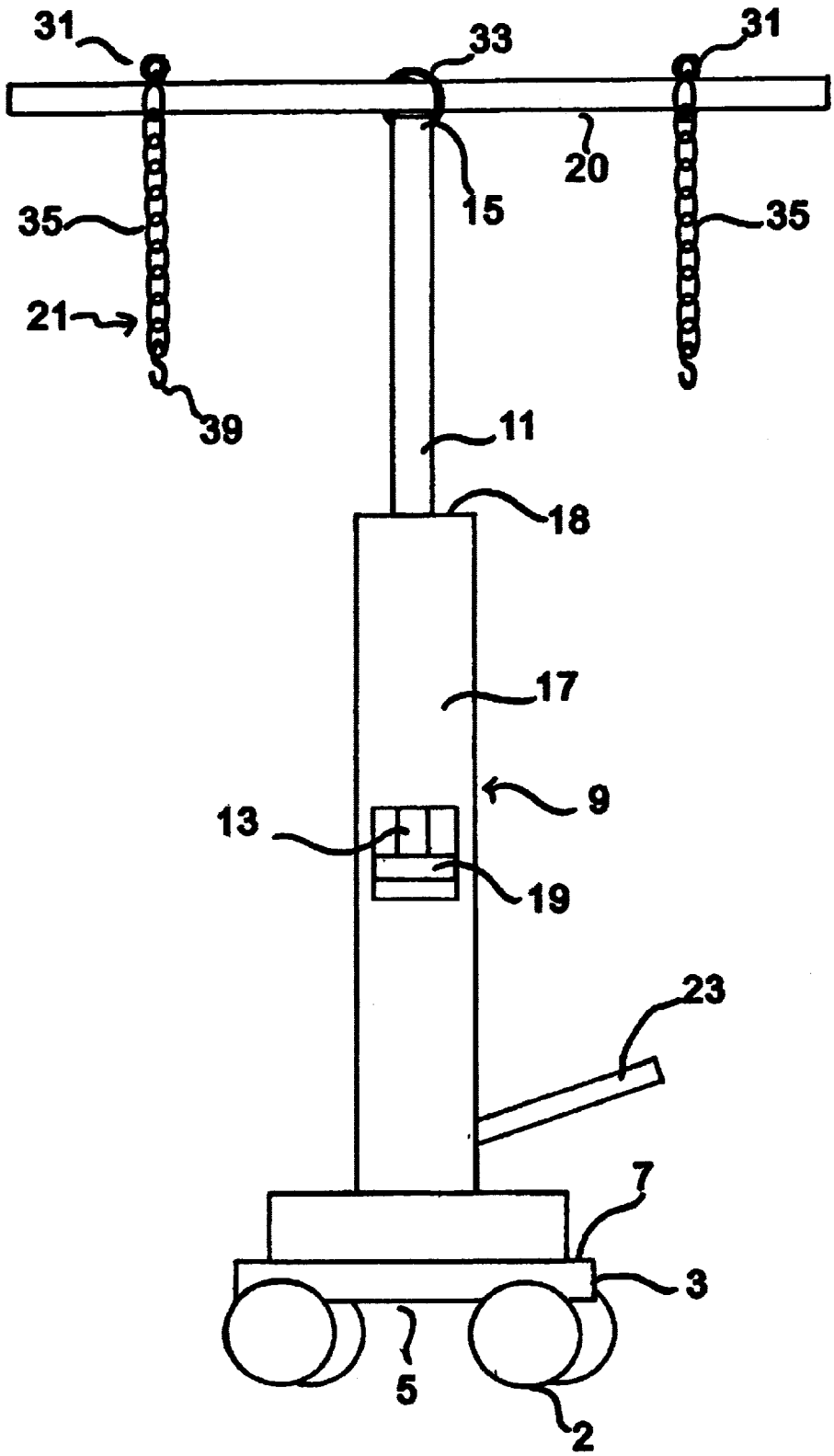
FIG. 1 is a front elevational view of the lifting device including a cutaway section revealing the pressure chamber and piston.
Figure 2:
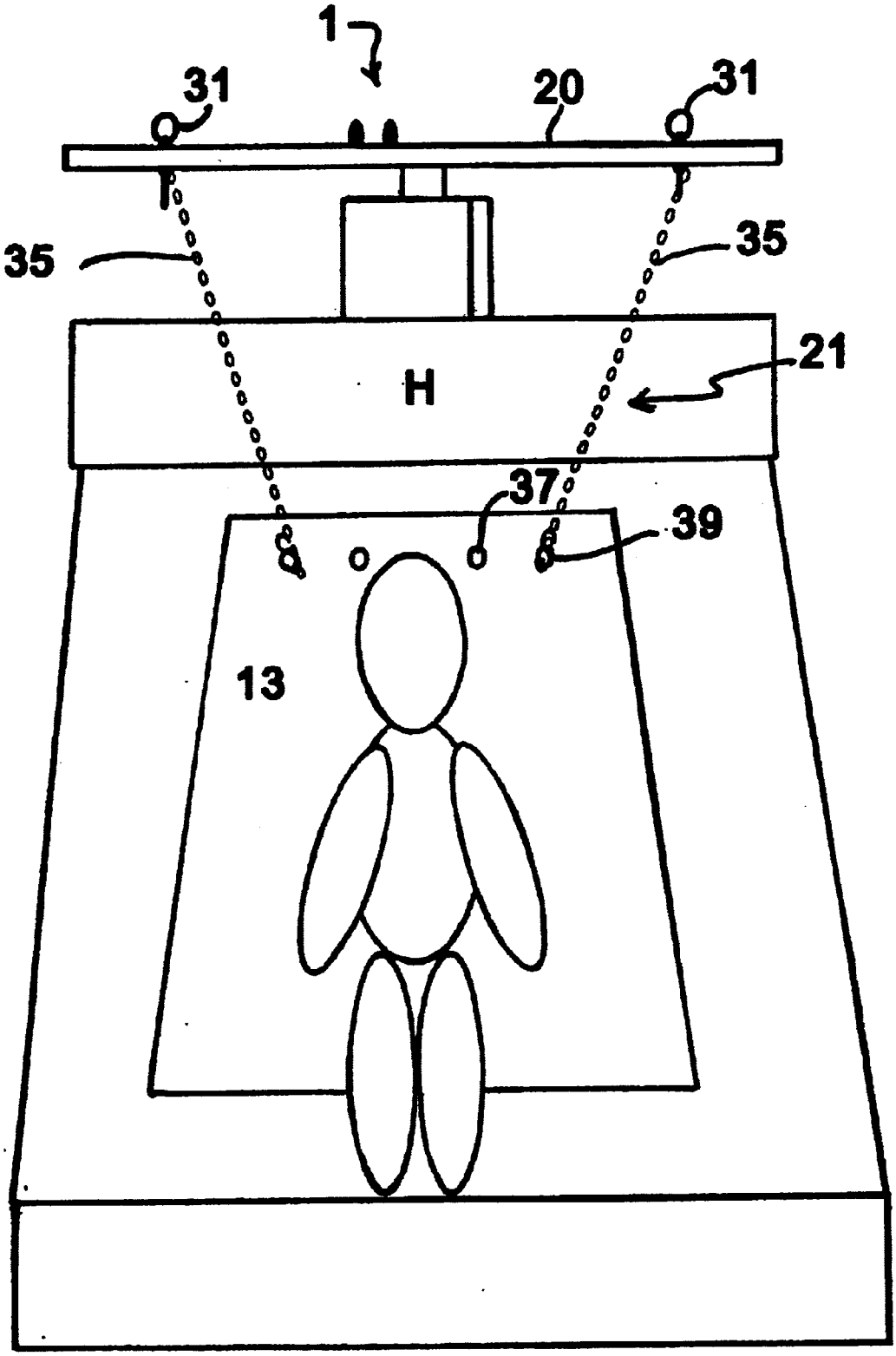
FIG. 2 is a front perspective view of the lifting device positioned in conjunction with a bed and patient.
Figure 3:
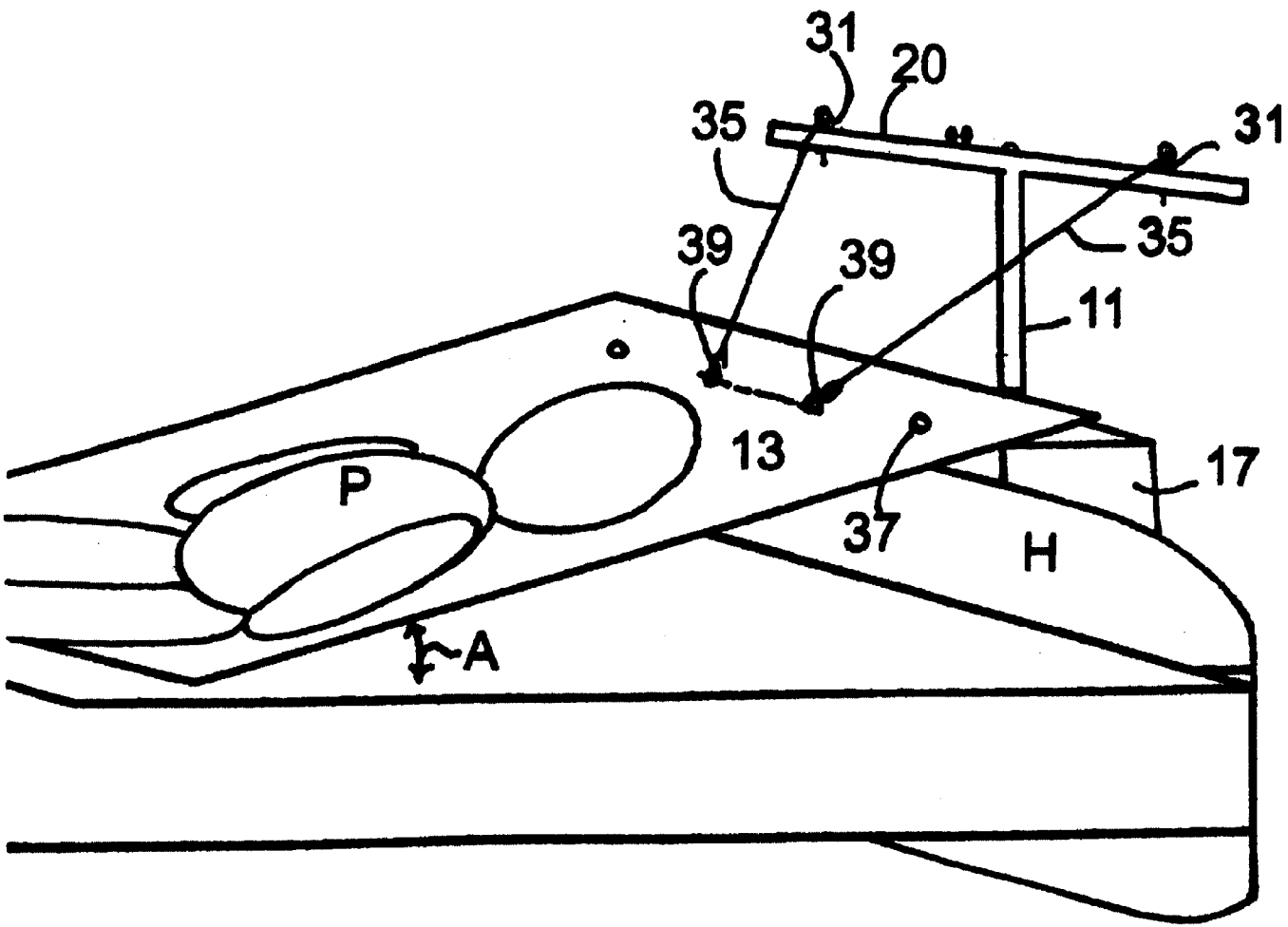
FIG. 3 is a side perspective view of the lifting device in operation with a bed and patient.

Now with reference to the drawings, wherein the pertinent elements are referenced numerically with FIGS. 1–3 showing various detailed elements of a first embodiment of the device.

In general as shown in FIG. 1, the patient adjustment device 1 includes a mobile base support 3 for allowing the rolling transport of the device along a floor, for instance in a hospital or other such patient care facility or in homecare. Attached to the underside 5 of the base assembly 3 is a rolling mechanism, in the present embodiment for example, a plurality of caster wheels 2, at least some of which may be lockable to stabilize the device. A top side 7 of the base support 3 supports a lifting mechanism 9 of the adjustment device 1. The main lifting mechanism 9 includes a vertically extending adjustment shaft 11 supporting a substantially horizontally affixed attachment boom 20. Connected to the attachment boom 20 is a tensionable adjustment pulling system 21 for ultimately adjusting the patient by translating the vertical adjustment of the shaft 11 and attachment boom 20 into a substantially horizontal adjustment force to properly realign the patient towards the head of a bed. A more detailed description of the present invention is provided below.

The lifting mechanism 9, which is generally fastened to the topside 7 of the base support 3 can be any raising and lowering device as is known in the art. In some cases the lifting mechanism 9 may be enclosed in a housing for purposes of aesthetics or functionality, safety or cleaning purposes however such a housing is not a necessity. The present embodiment utilizes a hydraulic pump for the lifting mechanism 9 which includes a piston 19 housed within a main cylinder 17. Attached to the piston 19 is a first end 13 of the shaft 11, which also has a second end 15 extending vertically above the piston 19 and is maintained externally of the main cylinder 17. The length of the shaft 11 passes through a top bore hole 18 of the hydraulic pump 17 and is, as known in the art, adjustable with respect to the bore hole 18, due to the piston 19 and the hydraulic pressure acting thereon.

The hydraulic pump lifting device 9 may be actuated by a manual or foot actuated pump handle 23, or by a motorized mechanism as is known in the art, which may be driven by connecting via conventional connections to any accessible electrical wall outlet and activated by a switch. The present embodiment employs a manually operated hydraulic jack, similar to a typical floor jack, which is operated manually by the pump handle 23. The pump handle 23 is connected to a mechanism which transfers a volume of hydraulic fluid to or from a hydraulic fluid reservoir, and thus as is well known in the art, the pressure within the cylinder 17 acting on the piston 19 is either increased or decreased via the control mechanism 3 resulting in the extension or retraction of the shaft 11 through the bore hole 18. The shaft may extend within a range of about 1–3 feet, although similar ranges would be apparent to those skilled in the art.

The shaft 11 is capable of extension from a low point to a high point preferably from a low position of between about 20 inches above the floor to a high position of about 50 inches above the floor, although other positions could be contemplated and attained. When the pressure is reduced within the cylinder 17 the piston influences the shaft 11 downward towards the lowest most position, and conversely when pressure is increased by the operator within the cylinder 17 the shaft 11 is influenced upwards towards the high point. As such hydraulically actuated pistons, pumps and shafts and the related control mechanisms are well known in the art, no further discussion is provided.

In the present embodiment, the shaft 11 supports the substantially horizontally aligned attachment boom 20 which is generally the main load bearing member of the lifting device 1. The attachment boom 20 moves vertically up and down correspondingly with the raising and lowering of the shaft 11 as described above. The attachment boom 20 can be of varying lengths dependent upon the space restrictions of a particular application and is generally attached at a midpoint to the second end 15 of the shaft 11. The boom 20 can range in length from about 10 inches to 40 inches although preferably about 30 inches. The attachment boom 20 is provided with either a single or a plurality of attachment points 31 along its length. The attachment points 31 are provided in the attachment boom 20 in order to securely attach the pulling system 21 to the attachment boom 20. The attachment points 31 may be moveable or adjustable along the length of the horizontal attachment boom 20 in order to accommodate differences in patient size, weight and space considerations as necessary.

As described above, the attachment boom 20 is connected at its midpoint in a substantially perpendicular manner with respect to the second end 15 of the shaft 11. The attachment boom 20 may be attached and supported by the shaft 11 in any manner as known in the art. The present embodiment utilizes a flexible connection or joint 32 between the shaft 11 and boom 20 members such that although the boom 20 is axially affixed substantially perpendicular to the shaft 11, there is also provided at least a small amount of angular flexibility between the two members, both in a vertical and horizontal manner. In other words, although the boom 20 is axially immovable relative to the shaft 11, the relative flexibility or play between the two members 11 and 20 in the horizontal and vertical planes enables the device 1, via the attachment boom 20 to better balance the respective horizontal and vertical forces applied by the pulling system 21 across the attachment boom 20 and the vertical shaft 11 due to a patient who is perhaps in an off center positioning on the bed as well as to provide certain flexibility in attachment of the pulling system 21 to the sheet while preparing a patient to be pulled up.

The flexible connection in the present embodiment is provided by an eyelet 33 fixed to the second end 15 of the shaft 11. The eyelet 33 defines a hole through which the attachment boom 20 is generally engaged. The eyelet 33 may fixedly engage the attachment boom 20 at its middle point where a bore hole through the boom 20 or a circumferential depression in the boom 20 with the eyelet 33 to secure the members together while maintaining a desired flexibility between the two members 11 and 20 due to the angularly flexible connection. The shaft 11 and boom 20 may also be secured rigidly together, eliminating the above described play in the members. Since any number of methods of joining the shaft 11 and boom 20 together besides that described above would be readily apparent to those of skill in the art, no further description is provided.

Turning to FIG. 2, the pulling system 21 provides at least a substantially flexible but tensionable connector element 35 between the sheet 13, described in further detail below, and the boom 20. In the present embodiment, a single connector element 35 extends from between each of the attachment points 31 on the boom 20 to a respective connection point on the sheet 13. The connector element 35 may be a chain as shown in the present embodiment or a length of cable or wire or even rope. The connector element 35 is usually static, i.e. is relatively unstretchable when tensioned and may also be provided with an adjustment device, for instance an s-hook 39 to vary the length of the connector elements 35 between the attachment point 31 on the boom 20 and the sheet 13 as necessary. The length of the connector elements 35 may be in the range of 6–36 inches, although a preferable range is about 12–24 inches.

The connector elements 35 of the pulling system 21 can be connected to the attachment points 31 of the attachment boom 20 by any means as are known in the art. In the present embodiment conventional eye-bolts are interchangeably situated at the attachment points 31 and may be attached to the plurality of attachment points 31 along the attachment boom 20. The first ends of the connector elements being hooked to or connected with the eyebolts at the attachment points 31, the second or free ends of the connector elements 35 are attached to the sheet 13.

The sheet 13 supports the load to be moved, more particularly the patient to be moved. The sheet 13 can be a flat, flexible material for instance cotton, plastic, nylon etc. namely any material which does not provide any discomfort for the patient when it is properly positioned beneath the patient. The sheet 13 can be left permanently, directly beneath the patient in case of the need to continuously adjust the patient P. With the patient or load to be moved placed directly on the sheet 13 it is to be appreciated that movement of the sheet 13, initiated in the present case by the adjustment mechanism 1, will result in the patient being moved contemporaneously with the sheet 13.

FIGS. 2 and 3 depict a generally rectangular, substantially flat durable sheet 13 upon which the patient P lies. This generally flat durable sheet 13 may be constructed of canvas or various other durable, yet pliable material. The dimensions of this sheet may vary, but preferred sizes are about 56 inches long, by about 24 inches wide, and 72 inches long, by about 28 inches wide, although other sizes may be apparent to those in the art. Generally it is smaller than the surface area of a typical hospital bed but large enough to encompass substantially the entirety of the patient P supported on the sheet 13. The sheet 13 is provided at one end, generally the end adjacent the head of the patient P and the head H of the bed, with a plurality of holes or grommets 37 through which the free ends of the connector elements 35 are passed to provide the necessary pulling force to realign the patient. The free end of each connector element 35 is attached to a grommet 37 by an s-hook 39, spring closure or any similar connection device as is known in the art. It is to be appreciated that any number of connection elements 35 can be used to connect the sheet 13 to the boom 20, and that the connector elements 35 can be arranged between any of the opposing attachment points 31 and grommets 39 in the sheet 13.

Preferably at least 2 connector elements 35 are provided, one on each respective side of the patient P to provide a substantially equal pulling force on each side of the patient P, although any number could be contemplated. An additional embodiment of the present invention is one in which there is a single attachment point at the second end 15 of the shaft 11 to which the two shown connector elements 35 are attached. The single attachment point can be facilitated by the removal of the attachment boom 20 member and the connection of the first ends of each of the connector elements 35 to the eyelet 33 at the end 15 of the shaft 11.

In order to accommodate various applications of thisdevice, it is to be appreciated that numerous designs for attaching the generally flat compliant sheet-like load carrying member 13 to the lifting device 1 via a flexible suspension means 11 may be utilized. As such different methods and similar connections would be apparent to those of ordinary skill in the art no further discussion is provided.

In an additional embodiment of the present invention there is a support device for fixedly attaching the patient lifting device 1 to a bed, a wall or other substantially immovable object. The support device is generally a support bracket attached to the headboard of a hospital or other bed defining a space or attachment mechanism for releasably engaging the lifting device 1. The support device maintains the lifting device 1 in a fixed relationship with respect to the bed so that any forces exerted on the lifting device 1 during pulling up the patient P do not upset or unbalance the lifting device 1. As such securing devices and attachments are readily apparent to one of skill in the art no further description is necessary.

Yet another embodiment of the present invention is one in which the means for extension of the vertical shaft 11 is powered by an electrically driven motor. In this embodiment of the present invention an electronic control device unique to the electric motor and lifting means system would be installed as well.

Referring now to FIG. 3 a detail description of the operation of the lifting device 1 moving a patient towards the head H of the bed is provided. Assuming that the sheet 13 is properly positioned and supporting the patient P on the surface of a hospital bed, and that the patient P has slipped downward towards the foot of the bed and away from the head H of the bed it is now necessary to pull the patient towards the head H of the bed. Rather than attempt to physically drag the patient P towards the head of the bed via manual means, the care giver utilizes the lifting device 1 which may be wheeled into the room or attached to the support adjacent the head H of the bed. With the lifting device 1 adjacent the head of the bed and substantially in line with the length of the patient P, the shaft 11 is in a lower most position and the free ends of the connector elements 35 suspended from the horizontal boom 20 are attached to the sheet 13, in the present embodiment clips or s-hooks 39 on the free end are connected with the grommets 37 in the sheet 13.

Once the connection elements 35 are secured to the grommets 37 of the sheet 13 in the manner as herein described, the care giver ensures that the patient is adequately positioned and supported on the sheet 13. With the above preparations complete, the care giver can operate the manual pump handle 23 or the electric motor of the lifting device, increasing the pressure within the cylinder 17 and raising the shaft 11 from the lower position to a higher position. As the shaft 11 and associated horizontal boom 20 are raised, a tensile force is applied along the connection elements 35 which in turn pull the sheet 13 toward the head of the bed.

This pulling force is composed of both a horizontal and a vertical component, both components directed along the longitudinal axis of the patient P as is readily understood by anyone of ordinary skill in the art. As seen in FIG. 3 the raising of the shaft 11 and boom 20 may in fact slightly incline the sheet 13 and the patient P at a substantially acute angle with respect to the bed due to the vertical component of the pulling force. The angle A may depend in part on the weight of the patient P and the actual height at which the lifting device is raised as well as the length of the connection elements 35.

With the lifting device 1 pulling the sheet 13 and consequently the patient P in both the horizontal and vertical direction, the patient P is pulled upwards towards the lifting device 1 and the head of the bed H. Once the patient has been realigned with respect to the head of the bed H the care giver ceases the pressure actuation in the cylinder 17 and begins decreasing the pressure in the cylinder 17 to lower the shaft 11 and hence the sheet 13 and patient P back down onto the bed. With the patient P now realigned on the bed, the connection elements 35 may be disconnected from the grommets or connection points 37 on the sheet 13 and the patient is now realigned and the lifting device 1 is available for use with any subsequent patient.

Without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A patient lifting device comprising;

a base support assembly;

a lift mechanism mounted on the base support assembly having a vertically adjustable shaft;

a control and adjustment device for vertical adjustment of the vertically adjustable shaft;

at least an attachment point positioned on a first end of the vertically adjustable shaft, and at least one connector extending between the attachment point and a load carrier horizontally and vertically spaced from the attachment point for supporting a patient;

a first position of the lift mechanism wherein the vertically adjustable shaft is in a vertically lower position and the load carrier is placed directly under the patient and horizontally spaced from the attachment point on the vertically adjustable shaft; and a second position of the lift mechanism wherein the vertically adjustable shaft is raised to a vertically higher position and the load carrier is pulled horizontally closer to the lift mechanism.

2. The patient lifting device as set forth in claim 1 wherein a plurality of locking castor wheels are attached to the base support assembly to provide mobility to the lifting device.

3. The patient lifting device as set forth in claim 2 further comprising at least one attachment point facilitating the attachment of the lift mechanism to a substantially stable object or device.

4. The patient lifting device as set forth in claim 1 wherein a substantially horizontal load bearing boom is attached to the first end of the vertically adjustable shaft.

5. The patient lifting device as set forth in claim 4 wherein the load carrier is a generally rectangular length of fabric having a top side edge and an opposing bottom side edge, the top side edge having an attachment point for connecting with the at least one connector extending between the attachment boom and the load carrier.

6. The patient lifting device as set forth in claim 5 wherein a plurality of attachment points are provided on the attachment boom for the adjustable attachment of the least one connector between the attachment boom and the load carrier.

7. The patient lifting device as set forth in claim 6 wherein the at least one connector is a flexible, tensionable connector comprising a first end attached to the attachment boom and a second end attached to the load carder for translating the vertical adjustment of the shaft into horizontal displacement of the load carrier.

8. The patient lifting device as set forth in claim 7 wherein the at least one flexible connector is at least one section of twisted wire cable.

9. The patient lifting device as set forth in claim 1 wherein the hydraulic pump is powered by an electric motor for extending and retracting said extendible shaft.

10. A patient relocation device for moving a patient horizontally from a first position spaced from the head of a bed to a second position closer to the head of the bed, the relocation device comprising:

a vertically aligned lifting mechanism having a vertically separated first position and second position, and a hydraulic control device operable by a caregiver for controlling movement of the lifting mechanism between the first and second position;

a load-bearing support attached to said lifting mechanism, the load bearing support having a plurality of substantially horizontally aligned attachment points;

a tensionable connector extending both horizontally and vertically from at least one of the plurality of attachment points to be attached to a generally flat, patient supporting carrying member horizontally spaced from the load bearing support; and said lifting mechanism further comprises a vertical shaft having an end supporting the load bearing support in a perpendicular manner with respect to the vertical shaft to form generally T shaped lifting mechanism aligned parallel with the head of the bed to facilitate the horizontal movement of the patient towards the head of the bed.

11. The patient lifting device as set forth in claim 10 wherein said lifting mechanism is provided with an attachment point facilitating the attachment of the device to a support bracket on a hospital bed.

12. The patient lifting device as set forth in claim 1 wherein said generally flat, patient supporting carrying member is a rectangular, length of durable fabric material having a top side edge and an opposing bottom side edge connected from said top side to the load bearing member via said connector.

13. The patient lifting device as set forth in claim 12 wherein the load bearing support is attached at a midpoint thereof directly to the vertically aligned lifting mechanism to define a first and second side member of the load bearing support, each side member having an adjustably mounted respective first and second attachment points, and respective first and second connectors are connected at their first ends to the respective first and second attachment points of the load bearing member, and the second ends of the first and second connectors are attached to spaced apart connection points on the top side of the carrying member to facilitate horizontal movement of the carrying member upon vertical movement of the load bearing member.

14. A method for realigning a patient from a position spaced from the head of a bed to a position closer to the head of the bed, the method comprising the steps of:

providing a lifting mechanism having a vertically separated first position and second position, and a hydraulic control device operable by a caregiver for controlling movement of the lifting mechanism between the first and second position;

attaching a load-bearing support to said lifting mechanism, the load bearing support having a plurality of substantially horizontally aligned attachment points;

extending a tensionable connector from at least one of the plurality of attachment points and attaching said connector to a generally flat, patient supporting carrying member.

* * * * *